United States Patent [19]

Overman

[11] 4,289,289

[45] Sep. 15, 1981

[54] SHELF SUPPORT MEMBER INCORPORATING INTEGRAL LIVE HINGE

[75] Inventor: Sherman A. Overman, Hollister, Calif.

[73] Assignee: Monterey Shelf, Inc., Hollister, Calif.

[21] Appl. No.: 87,216

[22] Filed: Oct. 22, 1979

[51] Int. Cl.[3] ..... A47B 57/08

[52] U.S. Cl. ..... 248/235; 108/107; 211/187

[58] Field of Search ..... 248/235, 243; 211/207, 211/208, 134, 187; 108/108, 109, 107, 106, 96, 105

[56] References Cited

U.S. PATENT DOCUMENTS

| | | | |
|---|---|---|---|
| 1,940,454 | 12/1933 | Karnes | 248/243 X |
| 2,967,625 | 1/1961 | Hoogenstyn | 108/107 X |
| 3,368,784 | 2/1968 | Peterson | 108/108 X |
| 3,645,486 | 2/1972 | Ferdinand et al. | 108/108 X |
| 4,067,530 | 1/1978 | Overman | 248/235 |

*Primary Examiner*—William E. Lyddane
*Attorney, Agent, or Firm*—John J. Leavitt

[57] ABSTRACT

Presented is a shelf support strip fabricated from a synthetic resinous material and comprising an elongated base member configured in channel form for strength and rigidity and having integrally formed therewith a series of spaced shelf support members connected to the shelf support strip by a "live" hinge that permits pivotal retraction of the shelf support member for placement of the shelf and which permits pivotal extension of the shelf support member to provide a shelf support surface in position to support a shelf thereon.

7 Claims, 5 Drawing Figures

SHELF SUPPORT MEMBER INCORPORATING INTEGRAL LIVE HINGE

BACKGROUND OF THE INVENTION

There has been a continuing need for a shelf support strip that may be rapidly applied, is economical to manufacture and which permits the ready applicability of shelves thereon without use of tools. The prior art is replete with many different types of shelf support brackets, hangers, strips and various other devices for supporting a shelf between two upright parallel end panels. So far as is known, the most pertinent prior art constitutes U.S. Pat. No. 4,067,530, issued to the inventor of the subject invention.

As in U.S. Pat. No. 4,067,530 one of the important objects of the present invention is to provide a shelf support strip that is wholly fabricated in a single operation from a synthetic resinous material.

Many conventional shelf support means utilize two or three different parts. One of such parts frequently takes the form of an elongated strip, pairs of which are securely fastened to opposite upstanding end panels in a shelf assembly, the elongated strips being apertured for application of a second member which is adjusted in height along the length of the strip so as to position the shelfs. The shelf support member applied to the apertured strip constitutes a separate element and therefore is not integral with the strip on which it is supported and has the tendency to introduce a weak link into the shelf support system. Accordingly, another object of the invention is to provide a shelf support strip in which all parts thereof except the screw or staple that attaches the strip to the shelf support end panel is integral and formed in a single unit.

Most conventional shelf support brackets and strips utilizing movable or adjustable shelf hanger units, generally are applied to an apertured strip so that the hanger unit may be adjusted in height depending upon the height of books, for instance, that might be stacked on a shelf. The present invention eliminates such extra and separate parts and provides a shelf support member integral with the shelf support base strip and formed in such a way that a shelf may be inserted below a shelf support member and may be raised upwardly so as to initially pivot the shelf support member to permit passage of the shelf, and which then pivots outwardly and provides a support surface beneath the bottom surface of the shelf so that the shelf may be properly positioned for support.

It has been found that a shelf support member that pivots on a "live" hinge to permit passage of a shelf into proper position is an advantage over the type of collapsible shelf support member taught in U.S. Pat. No. 4,067,530. Accordingly, another object of the present invention is the provision of a shelf support member that is connected to a shelf support strip by an integral "live" hinge and which when pivoted into shelf supporting position abuts a cross member on the shelf support strip in such a way that most of the weight of the shelf and its contents results in a compressive force being applied to the shelf support member and to the shelf support strip cross member against which it abuts.

In one aspect of the instant invention it has been found that added carrying capacity is provided when the shelf support member is provided with an upstanding flange that comes into contact with the end of the shelf when the shelf is in supported position. Accordingly, another object of the invention is to provide a shelf support strip incorporating a shelf support member that is integrally attached to the shelf support strip by means of a "live" hinge that permits the shelf support member to pivot toward and away from the end of an associated shelf, and which provides a flange member adapted to engage the associated end of a shelf when in supported position to thus increase the load carrying characteristics of the shelf support member.

In another aspect of the invention, it has been found that if the shelf support member connected integrally as it is to the shelf support strip is provided with a projecting flange that engages a rib or web on the shelf support strip when the shelf support member is in shelf-supporting position, additional load carrying capacity is provided to the assembly. Accordingly, a still further object of the invention is the provision of a shelf support strip incorporating an integral shelf support member connected to the shelf support strip by a "live" hinge, and which provides a shelf support surface associated with a projecting flange adapted to engage the associated web or rib of the shelf support strip when the shelf support member is in extended shelf-supporting position.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the shelf support strip of the invention comprises a channel shaped member preferably injection molded from a suitable synthetic resinous material and having a multiplicity of transversely extending reinforcing ribs formed within the channel at intervals therealong to lend strength to the web that extends integrally between the two side flanges of each channel. Also formed at spaced intervals along the length of the injection molded strip are apertures surrounded by integrally cylindrical support posts adapted to receive a screw to fasten the support strip to a supporting structure. At spaced intervals along the strip, there are provided a multiplicity or series of shelf support members, each shelf support member being integral with the strip and being formed with a generally flat upper shelf support surface which projects from the elongated strip at right angles thereto, and which forms the top surface of a generally box-shaped or quadrilaterally shaped body one end of which is integral with the strip. The configuration of the strip channel is such as to provide rigidity for the strip, while the configuration and thickness of the shelf support member is controlled to permit pivotal retraction of the shelf support member into the interior of the channel so that the end of a shelf may be squeezed past the retracted shelf support member in an upward direction until it is properly positioned for support on the top surface of the shelf support member after it has pivoted out of the channel into its normal position. In such normal shelf supporting position, the shelf support member is provided with an upstanding flange associated with the shelf support surface that is adapted to engage the end of the associated shelf. In another aspect of the invention, the shelf support member is provided with an upstanding flange associated with the shelf support surface that physically engages the back or inner surface or web of the channelized strip so that the load imposed by a shelf on one of the shelf support members is carried or resisted at two spaced locations along the channelized strip.

BRIEF DESCRIPTION OF THE DRAWINGS

The shelf support strips in FIG. 1 are shown actual size, while FIGS. 2 through 5 are illustrated twice actual size.

DESCRIPTION OF THE PREFERRED EMBODIMENT

Figure 1:
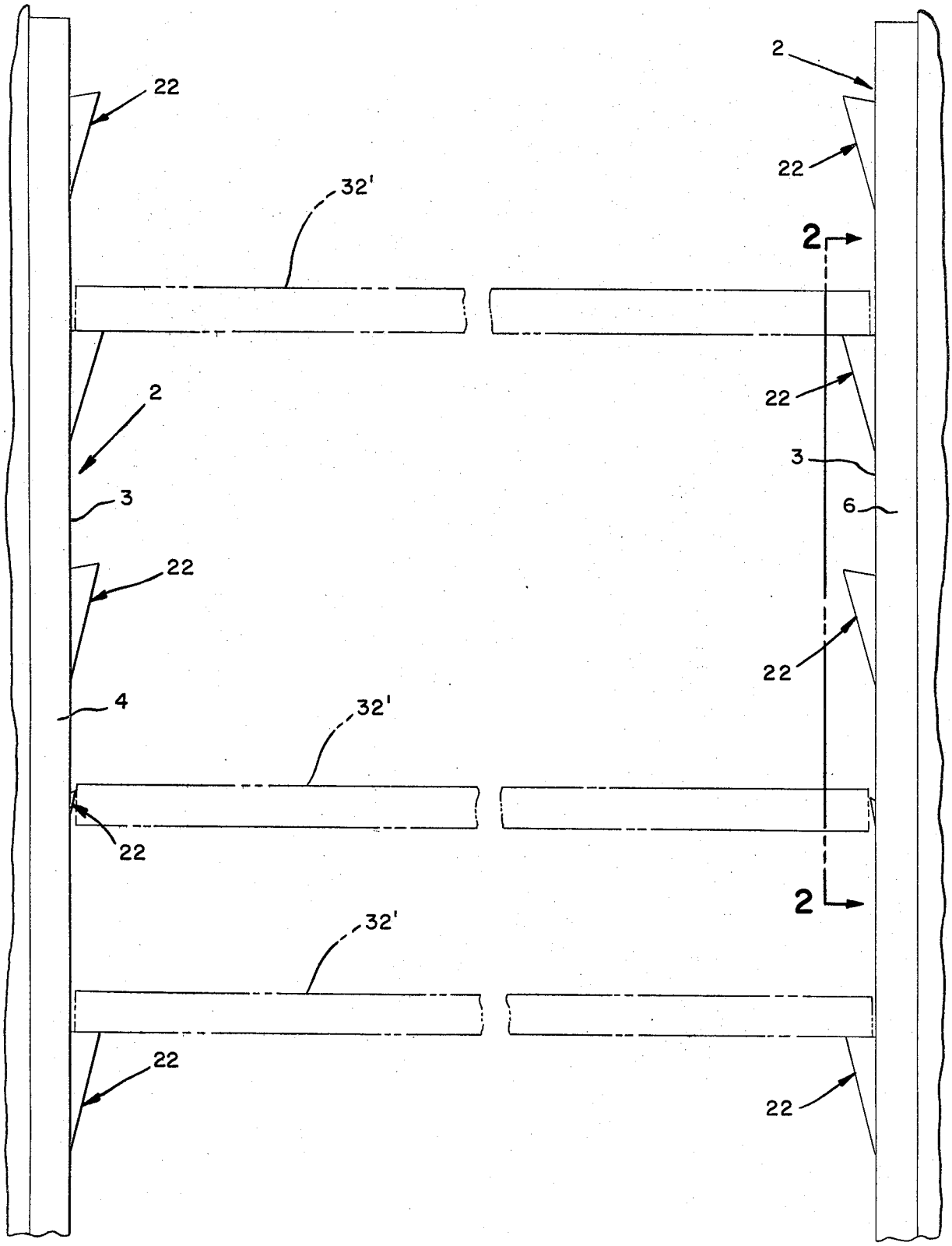
FIG. 1 is a front elevational view of a shelf assembly incorporating the shelf support strips of the invention. The view illustrates in broken lines two shelves fully supported on shelf support members and a third shelf in the process of being pressed upwardly past two oppositely positioned and retracted shelf support members.
Figure 2:
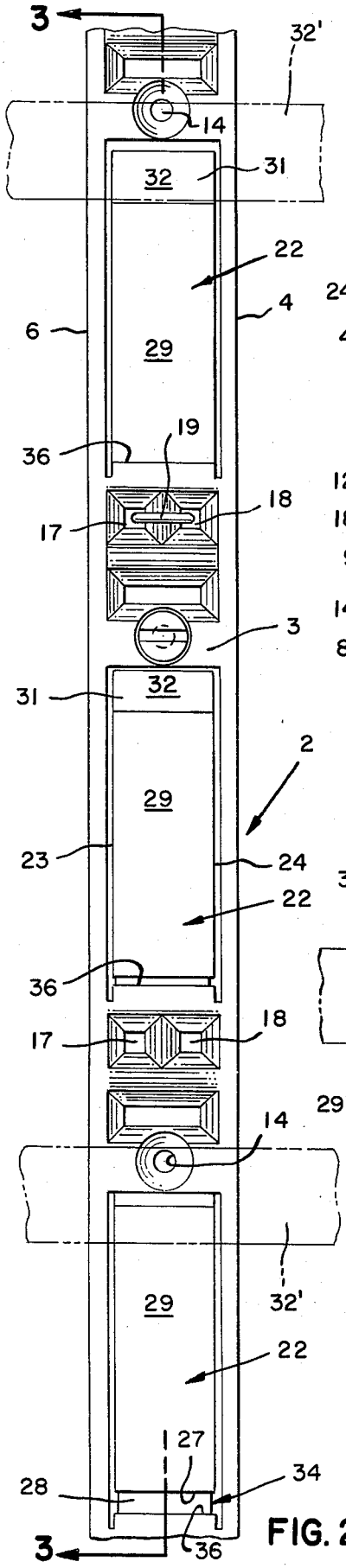
FIG. 2 is a front elevational view of one of the shelf support strips of the invention taken in the direction indicated by the arrow 2—2 in FIG. 1 and shown approximately twice actual size. A portion of the strip has been broken away to shorten the view.
Figure 4:
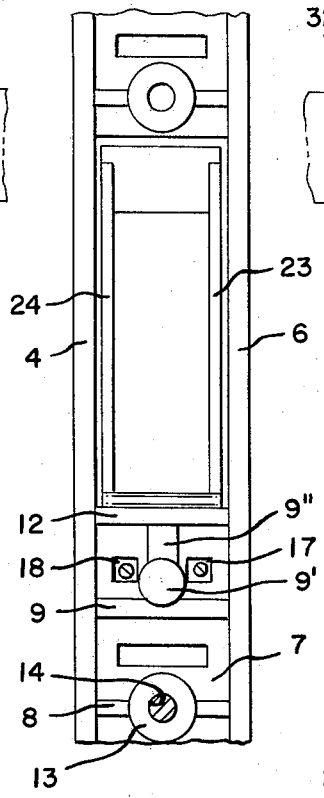
FIG. 4 is a rear view taken in the direction indicated by the arrows 4—4 in FIG. 3.

In terms of greater detail, the shelf support strip of the invention comprises an elongated unit designated generally by the numeral 2, and including a web portion 3 integral with a pair of side flanges 4 and 6, the side flanges and web defining a generally quadrilateral or U-shaped channel. Integrally formed at regular intervals on the inside surface 7 of the web are a plurality of reinforcing ribs 8, 9 and 12 that extend integrally between the side flanges 4 and 6 at intervals along the web and which are longitudinally spaced as illustrated to form a series of longitudinally spaced clusters of reinforcing ribs, the integral rib 8 extending transversally between the side flanges 4 and 6 and merging integrally with the outer periphery of a tubular projection 13 integral with the inside surface 7 of the web.

Figure 5:
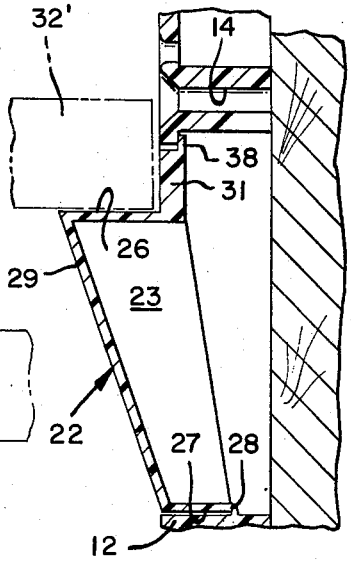
FIG. 5 is a fragmentary vertical cross-sectional view of a second embodiment of the invention.
Figure 3:
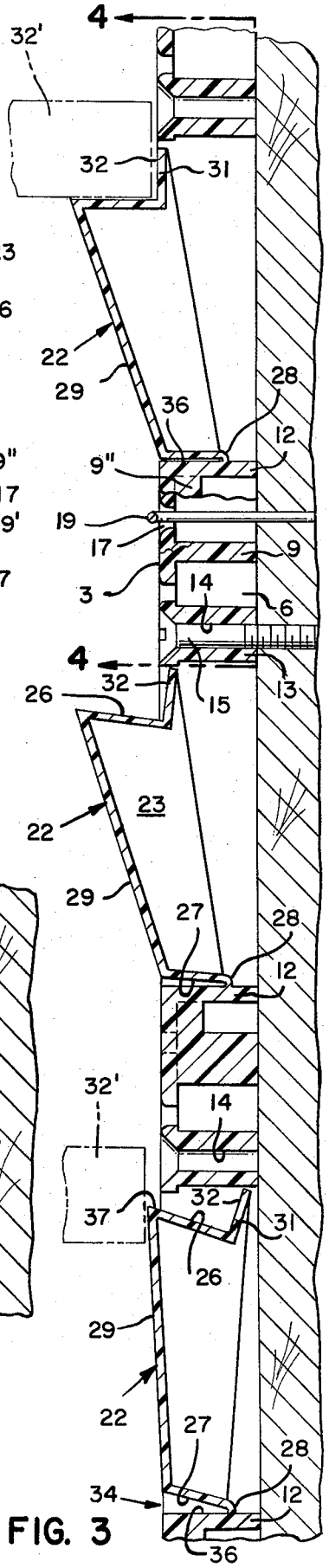
FIG. 3 is a vertical cross-sectional view taken in the plane indicated by the line 3—3 in FIG. 2.

The tubular projection provides a bore 14 through which a mounting screw 15 may be inserted, and as seen best in FIGS. 3 and 5, the outer or facing surface 16 of the web surrounding the bore is chamfered to receive the flathead mounting screw. The next adjacent or intermediate reinforcing rib 9 is also integrally disposed between the side flanges 4 and 6 and is of itself reinforced by a generally cylindrical projection 9' integral with one side thereof remote from reinforcing rib 8 and integral with a compression member 9'' extending generally longitudinally of the strip and joining the third reinforcing rib 12 integrally as shown. The compression member 9'' cooperates with flanges 4 and 6 to define a pair of apertures 17 and 18 formed in the facing web of the strip to receive the tines of an appropriate staple 19 driven through the apertures and into the underlying support structure. The compression member 9'' extending between the intermediate and third integral reinforcing ribs 9 and 12 respectively, also functions to rigidify the reinforcing rib 12 for purposes which will hereinafter be explained.

Integrally joined to the surface 21 of the reinforcing rib 12 on the side thereof remote from the intermediate rib 9 is a shelf support member designated generally by the numeral 22. The shelf support member 22 is box-like in its configuration, having two parallel sides 23 and 24 that are generally parallel to the associated flanges 4 and 6, and having end surfaces 26 and 27, both of these end surfaces being generally quadrilateral or rectangular in configuration, with one edge portion of the lower surface 27 being integrally united to the web 12 at a point between its top and bottom edges so as to provide a so called "live" hinge 28. Such a hinge is designated as being "live" because it joins integrally two parts that are pivotally related to each other.

From the drawings it will be seen that a front surface 29 of the box-like shelf support member is generally rectangular and integral with the parallel sides 23 and 24, while intercepting the end surfaces 26 and 27 at an angle. With respect to the top surface 26, which forms the shelf support surface when a shelf is imposed thereabove, the front face 29 intersects the top surface 26 at an acute angle. With respect to the lower surface 27, one rear edge of which is integrally united to the reinforcing rib 12 by a "live" hinge, the front face makes an obtuse angle. The opposite side of the shelf support member from the facing surface 29 is hollowed out as indicated in the drawings, primarily to reduce the weight of the strip. Obviously, where appropriate, the shelf support member could be solid rather than hollow.

Projecting from the surface 26 at the top end of the shelf support member is a projecting flange 31 which, in one aspect of the invention as illustrated in FIGS. 1 through 4, provides a front surface 32 perpendicular to the shelf support surface 26 and which is adapted to engage the extreme end surface of a superposed and properly supported shelf. In the drawings, in the interest of clarity, a slight space has been indicated between these opposed surfaces.

Referring to FIG. 3, it will there be seen that at the lowermost station there is illustrated a shelf support member 22 that has been retracted to permit the passage of a shelf 32' thereby. It should also be noted that at the lower end of the shelf support member where the lower edge portion is integrally attached by a "live" hinge to the surface 33 of reinforcing rib 12, the angular disposition of the lower end surface of the shelf support member provides a gap 34 between the lower surface 27 of the shelf support member and the associated surface 36 of the reinforcing rib 12. Additionally, it should be noted that at the opposite or upper end of the shelf support member, the depth of the shelf support member is somewhat greater than the depth of the channel formed by the strip so that when the shelf support member is fully retracted (bottom-FIG. 3) a corner portion 37 of the shelf support member projects from the face of the shelf support strip so that when the shelf is raised past the shelf support member and then lowered, the bottom surface of the shelf engages this shelf support portion, and the shelf support member is pivoted into its full extended position as illustrated at the top of FIG. 3.

In the embodiment of the invention illustrated in FIG. 5, corresponding reference members have been applied to corresponding elements of the combination and the structure is substantially identical except that the upwardly extending flange 31 associated with the shelf support surface 26 of the shelf support member is thickened somewhat and provided with an upwardly projecting buttress portion 38 that engages the rear surface 7 of the strip web as illustrated. The effect of this interengagement is to impose at two spaced locations along the strip, the force exerted by a downwardly pressing shelf. Thus, a major portion of the load is carried through compression of the shelf support member and the imposition of such compressive force on the strip through the abutment of the lower surface 27 with the surface 36 of the reinforcing rib 12. This interengagement is clearly shown in FIGS. 3 and 5. In addition, since downward pressure by the shelf tends to cause pivotal movement of the shelf support member counterclockwise as viewed in FIG. 5, the upwardly extending buttress portion 38 abutting the inner surface 7 of the shelf support strip counteracts such rotary moment, thus assisting the face-to-face abutment at the lower end of the shelf support member to withstand loads imposed thereon. Experience with these two different structures have indicated that substantially more weight may be supported on shelves utilizing the FIG. 5 embodiment as on shelves utilizing the FIGS. 1–4 embodiment.

It will thus be seen that there is provided as one integral unit a shelf support strip that is fabricated from a synthetic resinous material and which may be easily secured to a supporting structure either with screws as illustrated or with appropriate staples projected from a gun for that purpose.

Having thus described the invention, what is claimed to be new and novel and desired to be protected by letters patent of the United States is as follows:

1. A shelf support strip, comprising:

(a) an elongated base member formed from injection-molded synthetic resinous material; and (b) a series of integral injection-molded synthetic resinous material shelf support members longitudinally spaced on said base member and pivotal thereon between a retracted position and an extended shelf-support position to provide a shelf support surface perpendicular to said elongated base member when in extended shelf-support position and a force transferring portion connecting said perpendicular shelf support surface to a force transferring surface separable from said elongated base member when said shelf support members are in retracted position but abutting said base member when said shelf support member is in extended shelf-support position whereby a force imposed on said shelf support surface is transferred to said elongated base member through said force transferring portion and said force transferring surface.

2. The combination according to claim 1, in which each shelf support member comprises a hollow box-like body opposite ends of which are generally parallel to each other and two opposite sides of which are parallel.

3. The combination according to claim 1, in which each shelf support member is pivotally and integrally connected to said elongated base member by a "live" hinge.

4. A shelf support strip, comprising:

(a) an elongated base member; and (b) a series of shelf support members longitudinally spaced on said base member and each pivotal thereon between a retracted position and an extended shelf-support position to provide a shelf support surface perpendicular to said elongated base member when in extended shelf-support position and a force transferring portion connecting said perpendicular shelf support surface to a force transferring surface separable from said elongated base member but abutting said base member when said shelf support member is in extended shelf-support position;

(c) each said elongated base member including a generally U-shaped channel formed from synthetic resinous material and having side flanges connected integrally by a web, said web including a cluster of transversely extending reinforcing ribs each longitudinally spaced from the others and integral with said base member and defining attachment zones for said base member to a supporting structure.

5. The combination according to claim 4, in which said web includes a plurality of axially spaced transversely extending integral reinforcing ribs formed in the channel between said web and said side flanges, one of said reinforcing ribs including an integral tube adapted to recieve a mounting screw in the bore thereof, the remaining two integral reinforcing ribs being interconnected integrally by a longitudinally extending reinforcing member, one of said last mentioned reinforcing ribs being integrally connected to one edge portion of said shelf support member.

6. A shelf support strip, comprising:

(a) an elongated base member;

(b) a series of shelf support members longitudinally spaced on said base member and each pivotal thereon between a retracted position and an extended shelf-support position to provide a shelf support surface perpendicular to said elongated base member when in extended shelf-support position and a force transferring portion connecting said perpendicular shelf support surface to a force transferring surface separable from said elongated base member but abutting said base member when said shelf support member is in extended shelf-support position; and (c) flange means extending from each shelf support member next adjacent said shelf support surface and adapted to engage the end of a shelf supported on said shelf support surface.

7. A shelf support strip, comprising:

(a) an elongated base member; and (b) a series of shelf support members longitudinally spaced on said base member and each pivotal thereon between a retracted position and an extended shelf-support position to provide a shelf support surface perpendicular to said elongated base member when in extended shelf-support position and a force transferring portion connecting said perpendicular shelf support surface to a force transferring surface separable from said elongated base member but abutting said base member when said shelf support member is in extended shelf-support position;

(c) each said shelf support member being pivotally engaged integrally at one end to said elongated base member by a "live" hinge, and at its opposite end is provided with an upwardly extending buttress portion adapted to engage an associated portion of the elongated base member when said shelf support member is in shelf-supporting position so as to transmit the force imposed on said shelf support member by a shelf at two spaced locations to the elongated base member.

* * * * *

UNITED STATES PATENT AND TRADEMARK OFFICE

Certificate

Patent No. 4,289,289 Patented September 15, 1981

Sherman A. Overman

Application having been made by Sherman A. Overman, the inventor named in the patent above identified, and Monterey Shelf, Inc. the assignee, for the issuance of a certificate under the provisions of Title 35, Section 256, of the United States Code, adding the name of William H. James, Jr. as a joint inventor, and a showing and proof of facts satisfying the requirements of the said section having been submitted, it is this 9th day of Apr., 1985, certified that the name of the said William H. James, Jr. is hereby added to the said patent as a joint inventor with the said Sherman A. Overman.

Fred W. Sherling,
*Associate Solicitor.*